US012467453B2

(12) United States Patent
Anwer et al.

(10) Patent No.: US 12,467,453 B2
(45) Date of Patent: Nov. 11, 2025

(54) POWER END ROD ASSEMBLY

(71) Applicant: FORUM US, INC., Houston, TX (US)

(72) Inventors: Sohaib Anwer, Houston, TX (US); Stephen Patterson, Westhill (GB)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 18/492,449

(22) Filed: Oct. 23, 2023

(65) Prior Publication Data

US 2024/0271615 A1 Aug. 15, 2024

Related U.S. Application Data

(60) Provisional application No. 63/418,787, filed on Oct. 24, 2022.

(51) Int. Cl.
*F04B 53/14* (2006.01)

(52) U.S. Cl.
CPC ..... *F04B 53/147* (2013.01)

(58) Field of Classification Search
CPC ..... F04B 53/147; F04B 53/22
See application file for complete search history.

(56) References Cited

U.S. PATENT DOCUMENTS

| | | | | |
|---|---|---|---|---|
| 2,220,821 A | | 11/1940 | Mancuso | |
| 4,541,779 A | | 9/1985 | Birdwell | |
| 5,740,718 A | * | 4/1998 | Rathweg | F04B 53/164 92/255 |
| 5,904,071 A | * | 5/1999 | Kennedy | F04B 53/147 74/579 R |
| 10,036,384 B1 | * | 7/2018 | Jahnke | F16J 7/00 |
| 2019/0331110 A1 | | 10/2019 | Gable et al. | |

FOREIGN PATENT DOCUMENTS

SU 1677237 A1 9/1991

OTHER PUBLICATIONS

PCT International Search Report and Written Opinion dated Jan. 2, 2024, for International Application No. PCT/US2023/077512.

* cited by examiner

*Primary Examiner* — Bryan M Lettman
(74) *Attorney, Agent, or Firm* — Patterson + Sheridan, LLP

(57) ABSTRACT

Aspects of the present disclosure relate to reciprocating pumps, and specifically to power end rod assemblies, for pumping operations such as wellbore fracturing or drilling operations. The power end rod assembly comprises a power end rod comprising a body, a flanged end portion, and a shank portion. A wear plate is removably coupled to the shank portion by a securing member.

12 Claims, 9 Drawing Sheets

POWER END ROD ASSEMBLY

CROSS-REFERENCE TO RELATED APPLICATIONS

This application claims benefit of U.S. provisional patent application Ser. No. 63/418,787, filed Oct. 24, 2022, which is herein incorporated by reference in its entirety.

BACKGROUND

Field

Aspects of the present disclosure relate to reciprocating pumps, and specifically to power end rod assemblies, for pumping operations such as wellbore fracturing or drilling operations.

Description of the Related Art

Pressurized fluid delivery systems, such as reciprocating pumps, are used to transfer fluids at high pressures. High pressure fluid reciprocating pumps are commonly used in the oil and gas industry to conduct wellbore fracturing or drilling operations. These types of pumps include a power end, which drives the pump, and a fluid end, through which high pressure fluid is pumped. The connections between the power end and the fluid end endure significant stresses and strains during operation, which often result in failure.

Therefore, there is a need for new and/or improved reciprocating pump systems.

SUMMARY

Aspects of the present disclosure relate to reciprocating pumps, and specifically to power end rod assemblies, for pumping operations such as wellbore fracturing or drilling operations. The power end rod assembly comprises a power end rod comprising a body, a flanged end portion, and a shank portion. A wear plate is removably coupled to the shank portion by a securing member. An advantage of the removable wear plate is a quick and cost efficient method of repairing a power end rod assembly compared to replacing the entire power end rod itself.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Reciprocating pumps include a power end, which drives the pump, and a fluid end, through which high pressure fluid is pumped. The connections between the power end and the fluid end generally include a power end rod assembly, a link assembly, and a piston rod assembly. The power end rod assembly directly interfaces with the power end. The piston rod assembly directly interfaces with the fluid end. The link assembly directly interfaces with both the power end rod assembly and the piston rod assembly, and specifically couples the power end rod and piston rod assemblies together.

During installation and operation of the reciprocating pump, there is significant contact between an end surface of the power rod assembly and an end surface of the link assembly, which most often causes wear on the end of the power rod assembly. This wear on the power end rod assembly can lead to a failure of the connection to and operation of the link assembly, requiring replacement of the entire power end rod assembly. The embodiments of the power end rod assembly as described herein provide a quicker and more cost effective solution to the wear on power end rod assembly without having to replace the entire power end rod assembly.

Figure 1:
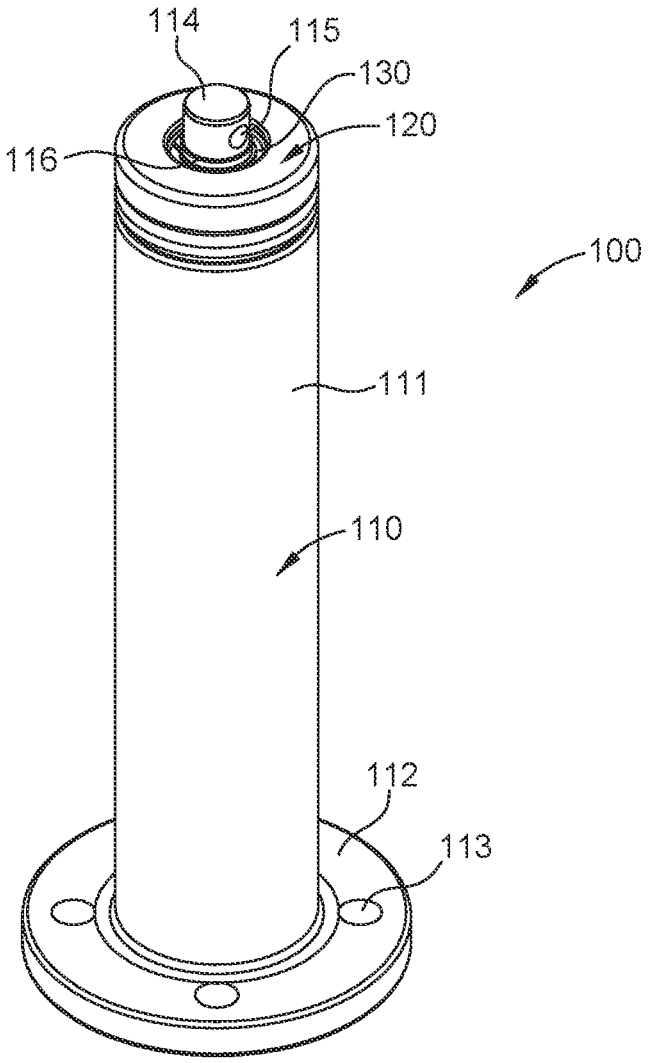
FIG. 1 is a perspective view of a power end rod assembly, according to one embodiment.
Figure 2:
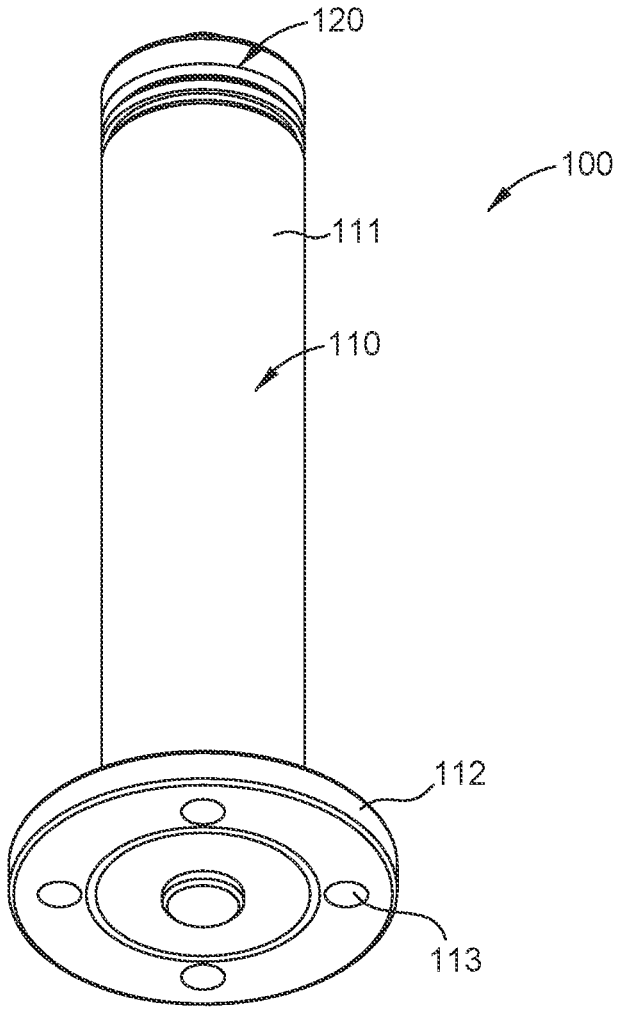
FIG. 2 is another perspective view of the power end rod assembly, according to one embodiment.
Figure 3:
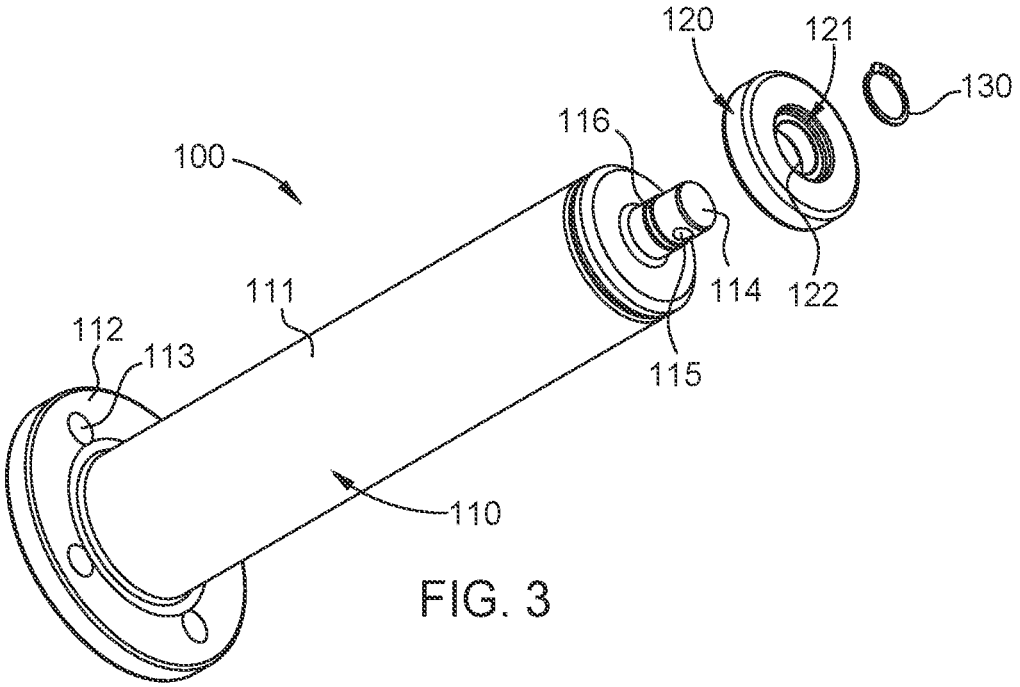
FIG. 3 is an exploded view of the power end rod assembly, according to one embodiment.
Figure 4:
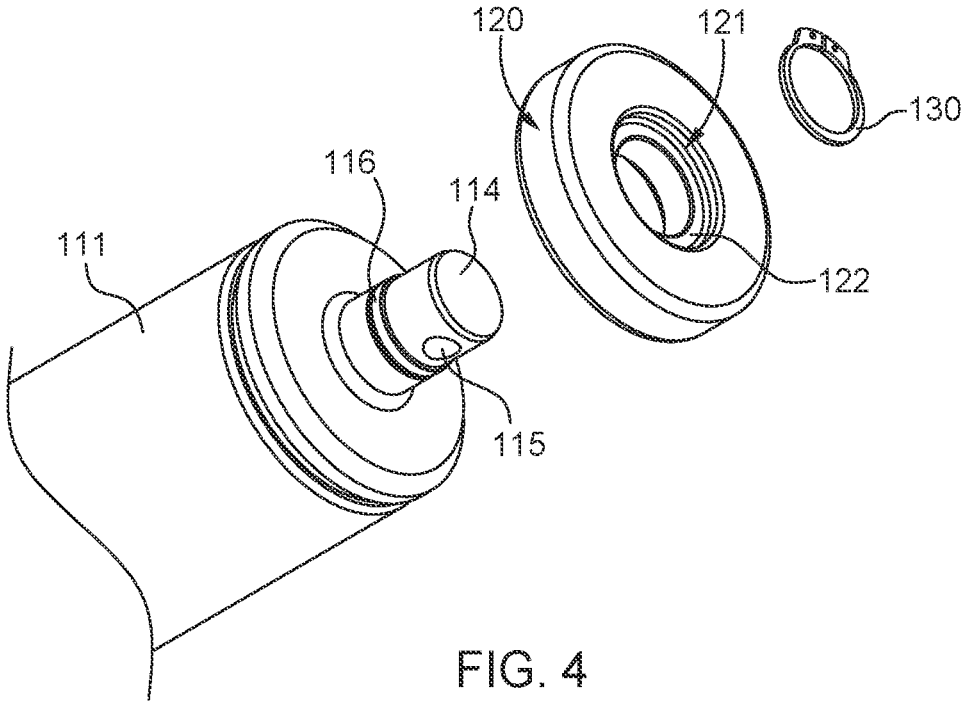
FIG. 4 is an enlarged, exploded view of a portion of the power end rod assembly, according to one embodiment.
Figure 5:
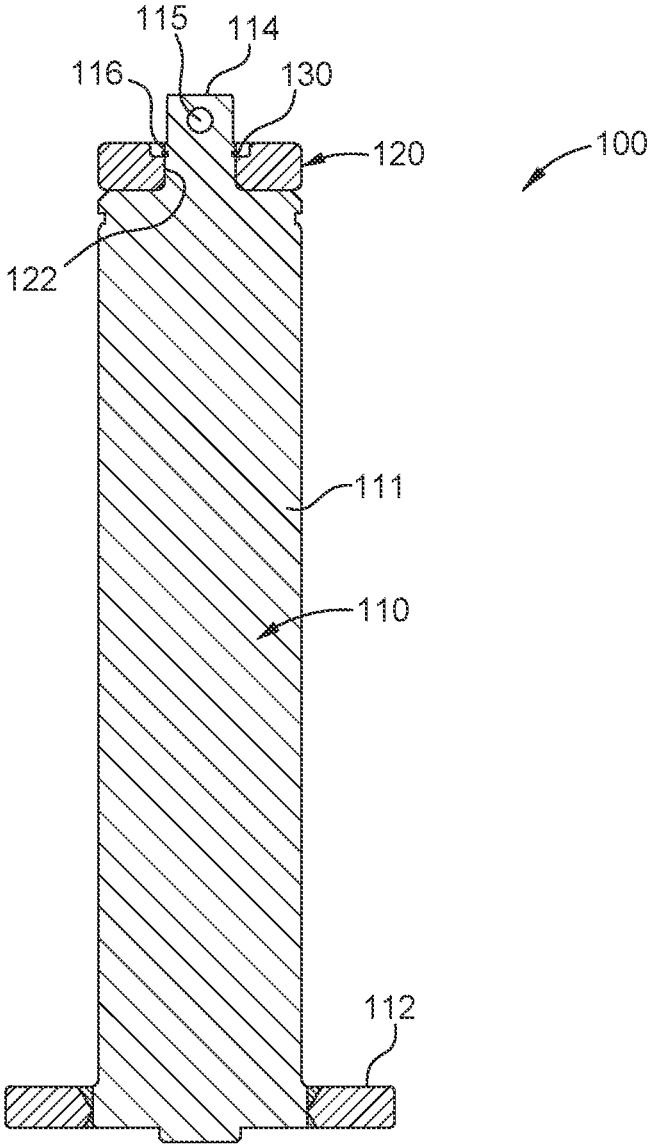
FIG. 5 is a sectional view of the power end rod assembly, according to one embodiment.
Figure 6:
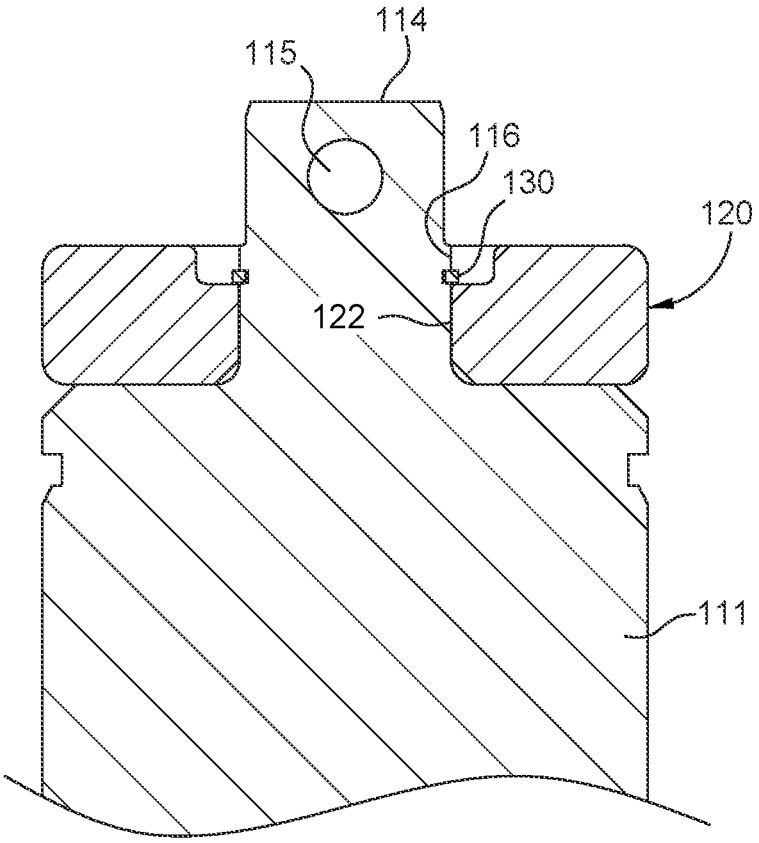
FIG. 6 is an enlarged, sectional view of a portion of the power end rod assembly, according to one embodiment.

FIG. 1 is a perspective view of a power end rod assembly 100, according to one embodiment. FIG. 2 is another perspective view of the power end rod assembly 100, according to one embodiment. FIG. 3 is an exploded view of the power end rod assembly 100, according to one embodiment. FIG. 4 is an enlarged, exploded view of a portion of the power end rod assembly 100, according to one embodiment. FIG. 5 is a sectional view of the power end rod assembly 100, according to one embodiment. FIG. 6 is an enlarged, sectional view of a portion of the power end rod assembly 100, according to one embodiment.

With reference to FIGS. 1-6, the power end rod assembly 100 includes a power end rod 110, a wear plate 120, and a securing member 130 configured to couple the wear plate 120 to the power end rod 110. The power end rod 110 includes a body 111 having a flanged end portion 112 and a shank portion 114 disposed at opposite ends of the body 111. The flanged end portion 112 may be integrally formed with the body 111 or may be coupled to the body 111 such as by welding. The flanged end portion 112 includes one or more bolt holes 113 for coupling the power end rod 110 to a power end of a reciprocating pump.

The shank portion 114 of the body 111 may be integrally formed with the body 111 or may be coupled to the body 111 such as by welding. The shank portion 114 has an outer diameter and a length that is less than an outer diameter and a length of the body 111. The shank portion 114 includes a pin hole 115 for coupling the power end rod 110 to a link assembly 200 (illustrated in FIGS. 7-10). The shank portion 114 also includes an outer shoulder 116 for retaining the securing member 130 to the shank portion 114, which thereby retains the wear plate 120 to the body 111 as further described below.

The wear plate 120 may be a cylindrical member having a bore 121 and an inner shoulder 122. The inner diameter of the inner shoulder 122 is sized to allow the wear plate 120 to be positioned on the shank portion 114 of the body 111 of the power end rod 110. When the wear plate 120 is positioned on the shank portion 114, the securing member 130 is then positioned on the outer diameter of the shank portion 114 below the outer shoulder 116 of the shank portion 114 and above the inner shoulder 122 of the wear plate 120. When positioned on the outer diameter of the shank portion 114, the outer diameter of the securing member 130 is greater than the inner diameter of the inner shoulder 122 of the wear plate 120 thereby retaining the wear plate 120 to the shank portion 114.

The securing member 130 is illustrated as a flexible circlip but may be in the form of other types of members to couple the wear plate 120 to the power end rod 110. The securing member 130 may comprise one or more flexible circlips, pins, bolts, screws, clamps, magnets, adhesives, or combinations thereof. In the event of significant wear to the wear plate 120, the securing member 130 may be removed from the shank portion 114 of the power end rod 110 to allow the removal of the wear plate 120. A new wear plate 120 can then be installed onto the shank portion 114 of the power end rod 100 and retained with the securing member 130 as described herein.

Figure 7:
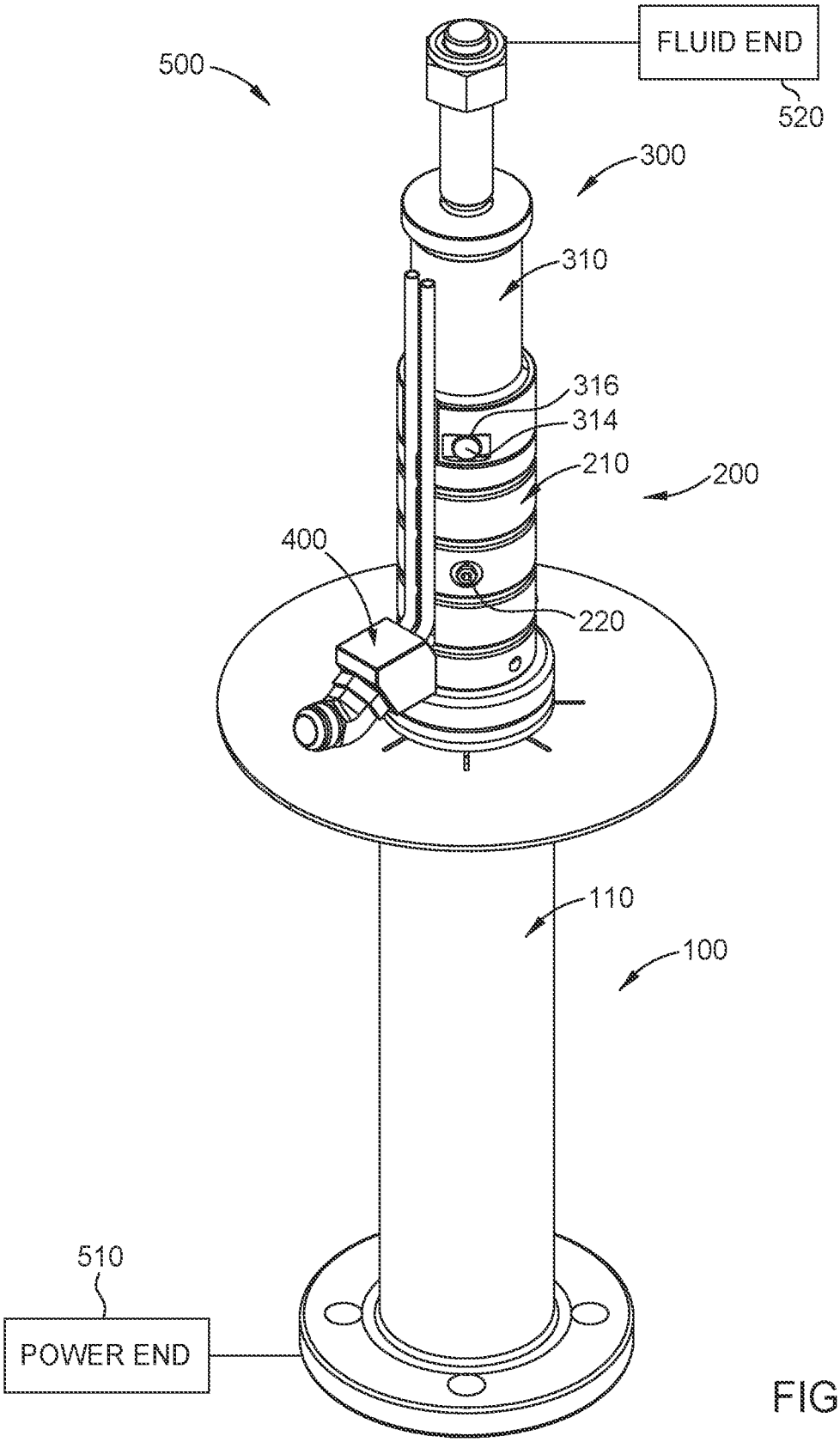
FIG. 7 is a perspective view of a connection assembly, according to one embodiment.
Figure 8:
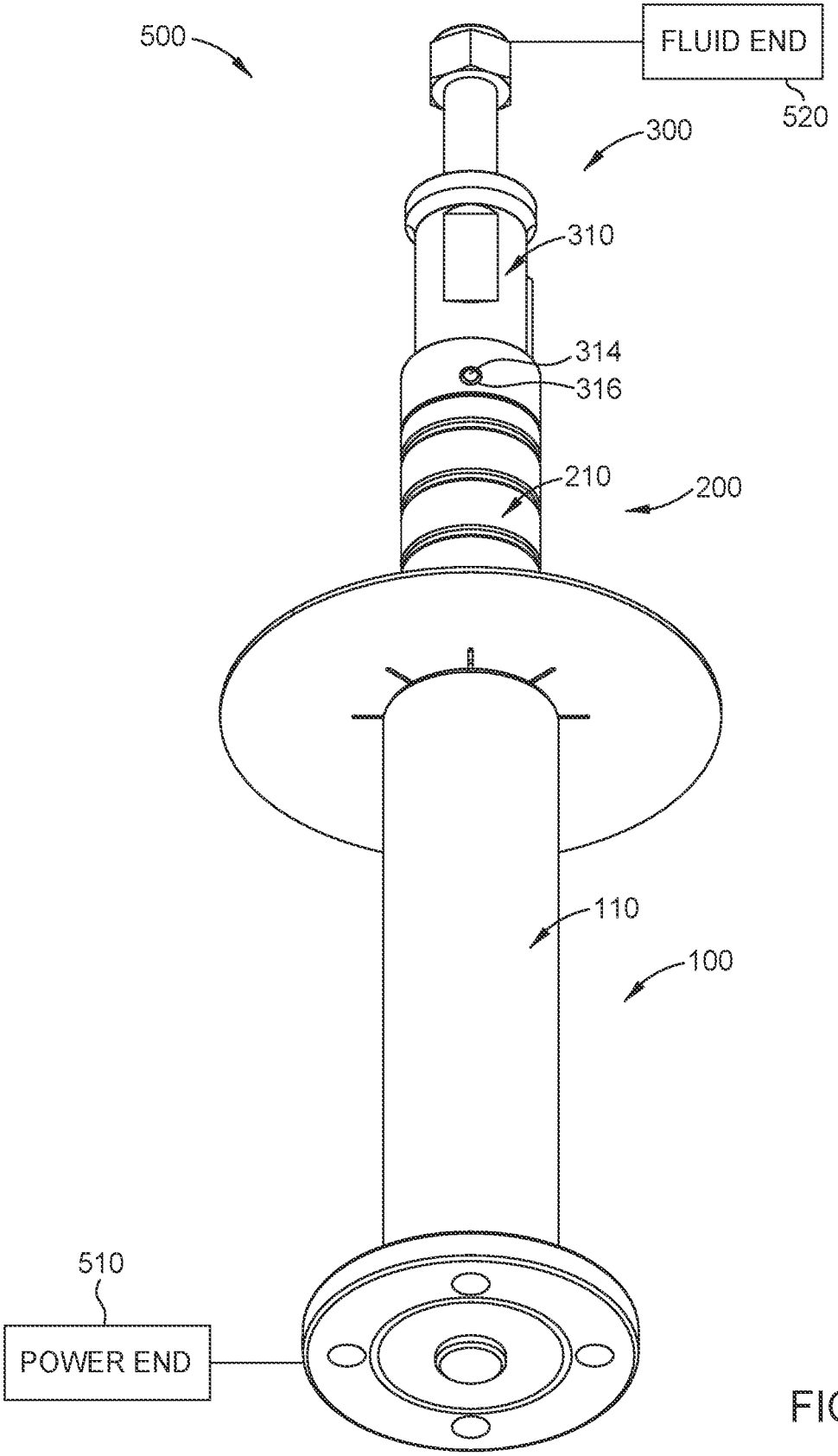
FIG. 8 is another perspective view of the connection assembly, according to one embodiment.

FIG. 7 is a perspective view of a connection assembly 500, according to one embodiment. FIG. 8 is another perspective view of the connection assembly 500, according to one embodiment.

With reference to FIGS. 7 and 8, the connection assembly 500 is positioned between a power end 510 and a fluid end 520, which are schematically illustrated. The power end 510, the fluid end 520, and the connection assembly 500 may be in the form of a reciprocating pump. The power end 510 moves, such as by reciprocating, the connection assembly 500 relative to the fluid end 520 to draw fluid into the fluid end 520 (such as during a suction stroke), and then pressurize and pump the fluid out of the fluid end 520 (such as during a discharge stroke).

The connection assembly 500 includes the power end rod assembly 100 having the power end rod 110, a link assembly 200 having a hydraulic cylinder 210, and a piston rod assembly 300 having a piston rod 310. The link assembly 200 is configured to provide a releasable connection between the power end rod assembly 100 and the piston rod assembly 300. A supply port 220 may be used to supply pressurized fluid to the hydraulic cylinder 210 of the link assembly 200 to connect and disconnect the link assembly 200 from the power end rod assembly 100 and/or the piston rod assembly 200. Optionally a lubrication assembly 400 may be coupled to link assembly 200 for providing lubrication fluid to the piston rod assembly 300.

Figure 9:
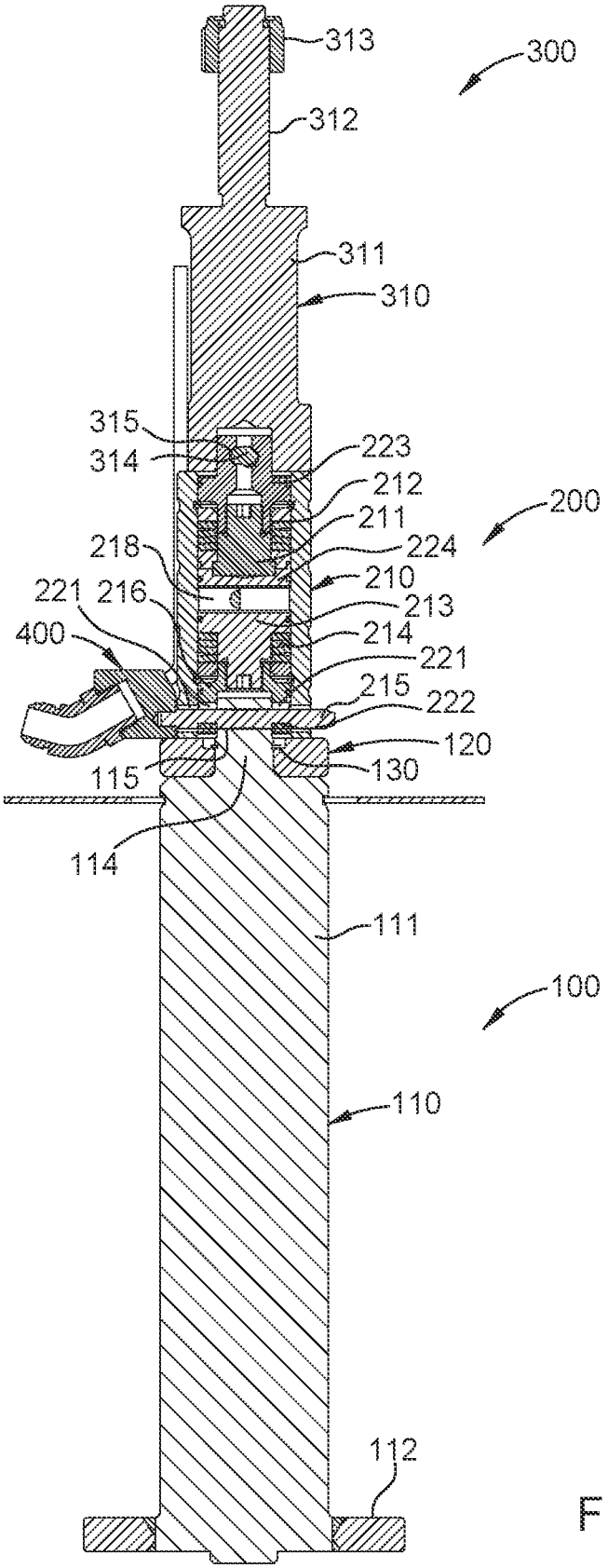
FIG. 9 is a sectional view of the connection assembly, according to one embodiment.
Figure 10:
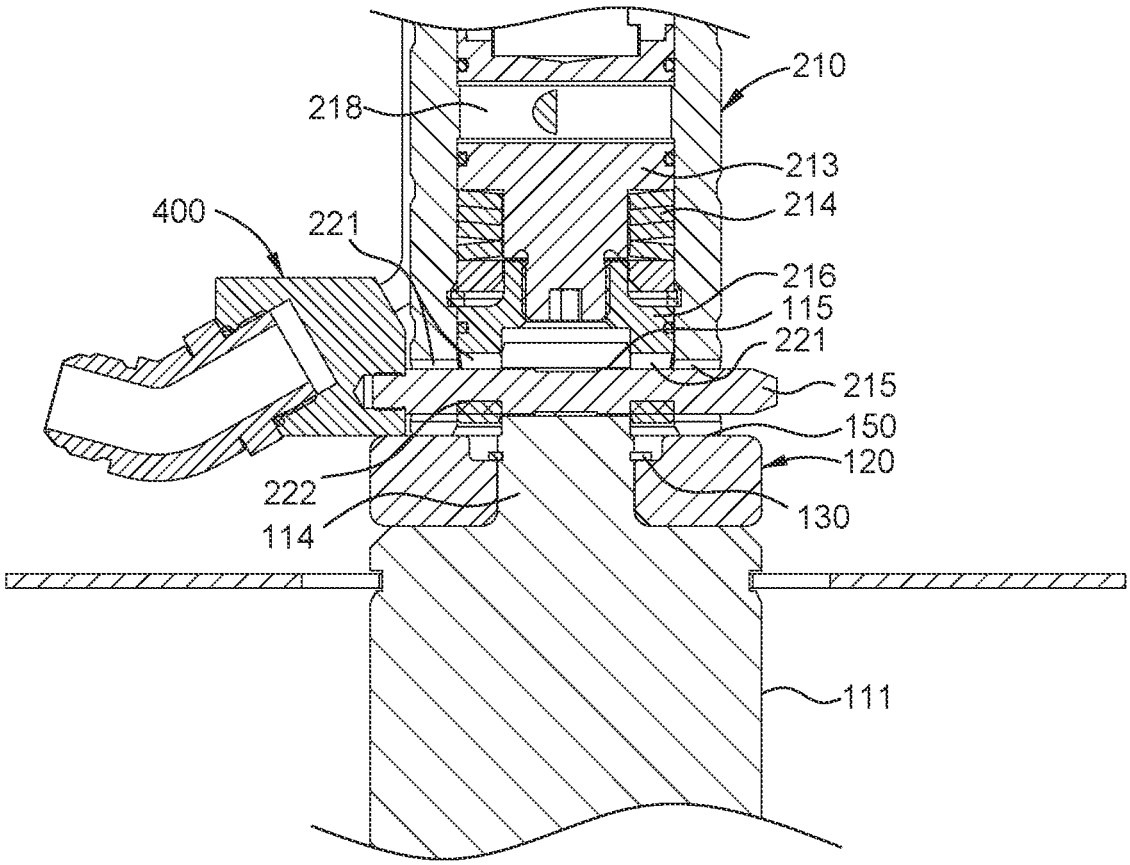
FIG. 10 is an enlarged, sectional view of a portion of the connection assembly, according to one embodiment.

FIG. 9 is a sectional view of the connection assembly 500, according to one embodiment. FIG. 10 is an enlarged, sectional view of a portion of the connection assembly 500, according to one embodiment.

With reference to FIGS. 9 and 10, the piston rod 310 includes a body 311 having a shank portion 312, and a piston 313 coupled to the shank portion 312. An end of the body 311 of the piston rod 310 contacts the hydraulic cylinder 210. The link assembly 200 connects the piston rod assembly 300 to the power end rod assembly 100 as further described below.

The link assembly 200 includes a first piston 213, a first biasing/retaining assembly 214, and a first end cap member 216 disposed in the hydraulic cylinder 210. The first piston 213 is coupled to the first end cap member 216. The first biasing/retaining assembly 214 is disposed between the first piston 213 and the first end cap member 216. The first biasing/retaining assembly 214 may be configured to at least partially retain the first piston 213 and/or the first end cap member 216 within the hydraulic cylinder 210. The first biasing/retaining assembly 214 is also configured to bias the first piston 213 and the first end cap member 216 in a direction toward the piston rod assembly 300 when the hydraulic cylinder 210 is not pressurized.

The link assembly 200 further includes a second piston 224, a second biasing/retaining assembly 212, a piston support member 211, and a second end cap member 223 at least partially disposed in the hydraulic cylinder 210. The second piston 224 is coupled to the piston support member 211, which is coupled to the second end cap member 223. The second biasing/retaining assembly 212 is disposed between the second piston 224 and the second end cap member 223. The second biasing/retaining assembly 212 may be configured to at least partially retain the second piston 224, the piston support member 211, and/or the second end cap member 223 to the hydraulic cylinder 210. The second biasing/retaining assembly 212 is also configured to bias the second piston 224, the piston support member 211, and the second end cap member 223 in a direction toward the power end rod assembly 100 when the hydraulic cylinder 210 is not pressurized.

A chamber 218 is formed between the first piston 213 and the second piston 224 within the hydraulic cylinder 210. When the chamber 218 is pressurized with hydraulic fluid (supplied via the supply port 220 illustrated in FIG. 7 for example), the fluid pressure forces the first piston 213 against the first biasing/retaining assembly 214 to compress the first biasing/retaining assembly 214 and to move the first piston 213 and the first end cap member 216 in a direction toward the power end rod assembly 100. In the pressurized position, the shank portion 114 of the power end rod 110 can be inserted at least partially into the first end cap member 216 in a manner that the pin hole 115 in the shank portion 114 of the power end rod 100 aligns with pinholes 221 formed in the body of the hydraulic cylinder 210 and in the body of the first end cap member 216.

A pin 215, such as a retention pin, can then be inserted through the aligned pin holes 115, 221. Once the pin 215 is in place, the pressurized fluid can be removed from the chamber 218 so that the first biasing/retaining assembly 214 biases the first piston 213 and the first end cap member 216 back in a direction toward the piston rod assembly 300. The bias force placed on the first end cap member 216 is also placed on the pin 215, such as by the inner surfaces 222 of the first end cap member 216, to secure the power end rod 110 to the link assembly 200.

Similarly, when the chamber 218 is pressurized with hydraulic fluid (supplied via the supply port 220 illustrated in FIG. 7 for example), the fluid pressure forces the second piston 224 against the second biasing/retaining assembly 212 to compress the second biasing/retaining assembly 212 and to move second piston 224, the piston support member 211, and the second end cap member 223 in a direction toward the piston rod assembly 300. In the pressurized position, an end portion of the second cap member 223 can be inserted at least partially into the body 311 of the piston rod 310 in a manner that one or more pin holes 315 formed in the second cap member 223 align with one or more pin holes 316 formed in the body 311 of the piston rod 310.

A pin 314 can then be inserted through the aligned pin holes 315, 316. Once the pin 314 is in place, the pressurized fluid can be removed from the chamber 218 so that the second biasing/retaining assembly 212 biases the second piston 224, the piston support member 211, and the second end cap member 223 back in a direction toward the power end rod assembly 100. The bias force placed on the second end cap member 223 is also placed on the pin 314, such as by the inner surfaces of the second end cap member 223, to secure the piston rod 310 to the link assembly 200.

When needed, pressurized fluid can be reintroduced into the chamber 218 to disconnect the power end rod assembly 100 and/or the piston rod assembly 300 from the link assembly 200. During this process and/or during operation of the reciprocating pump, there is significant contact between an end surface of the wear plate 120 and an end surface of the hydraulic cylinder 210, such as at interface 150 illustrated in FIG. 10. Over time, the impact between the wear plate 120 and the hydraulic cylinder 210 at the interface 150 may result in a groove or depression being formed in the surface of the wear plate 120 by the hydraulic cylinder 210.

The groove or depression allows the position of the hydraulic cylinder 210 to shift closer to the power end rod 110 in a manner that reduces the amount of force that the first biasing/retaining assembly 214 places on the first piston 213 and the first end cap member 216. The reduction in force may compromise the connection between the power end rod assembly 100 and the link assembly 200, which can lead to failure and/or damage to other components of the power end rod assembly 100, the link assembly 200, and/or the piston rod assembly 300. Therefore, when needed, the link assembly 200 can be disconnected from the power end rod assembly 100 so that the wear plate 120 can be more quickly and easily replaced as opposed to replacing the entire power end rod 110, which is more costly and time intensive.

In one embodiment, the link assembly 200 may be a non-hydraulic, mechanical release link configured to connect and disconnect the power end rod assembly 100 to and from the piston rod assembly 300. Instead of hydraulic fluid, a mechanical force applied by a tool for example may be used to move the link assembly 200 into a position where the pins 215, 315 can be inserted and then released. Wear is similarly caused by the significant contact between the end surface of the wear plate 120 and the end surface of the mechanical release link at the interface 150 illustrated in FIG. 10. Over time, the impact between the wear plate 120 and the mechanical release link at the interface 150 may result in a groove or depression being formed in the surface of the wear plate 120, which similarly results in a reduction of the amount of force applied by the mechanical release link, thereby resulting in failure.

Any one or more components of the power end rod assembly 100, the link assembly 200, and/or the piston rod assembly 300 may be integrally formed together, directly coupled together, and/or indirectly coupled together, and are not limited to the specific arrangement of components illustrated in FIGS. 1-10.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A power end rod assembly, comprising:

a power end rod comprising a body, a flanged end portion located at one end of the body, and a shank portion located at an opposite end of the body, wherein the shank portion has an outer diameter and a length that is less than an outer diameter and a length of the body;

a securing member removably coupled to the shank portion; and a wear plate removably coupled to the shank portion by the securing member, wherein the securing member is positioned between an outer shoulder of the shank portion and an inner shoulder of the wear plate, and wherein an outer diameter of the securing member is greater than an outer diameter of the outer shoulder of the shank portion and greater than an inner diameter of the inner shoulder of the wear plate to retain the wear plate to the shank portion.

2. The power end rod assembly of claim 1, wherein the inner diameter of the inner shoulder of the wear plate is greater than the outer diameter of the outer shoulder of the shank portion.

3. The power end rod assembly of claim 1, wherein the securing member comprises one or more flexible circlip, pin, bolt, screw, clamp, magnet, adhesive, or a combination thereof.

4. The power end rod assembly of claim 1, wherein the shank portion is disposed through a bore formed through the wear plate.

5. The power end rod assembly of claim 4, wherein an end face of the wear plate is in contact with an end face of the body of the power end rod adjacent to the shank portion.

6. The power end rod assembly of claim 5, wherein a pin hole is disposed through the shank portion at a position adjacent to the outer shoulder of the shank portion.

7. The power end rod assembly of claim 5, wherein an outer diameter of the wear plate is substantially the same as the outer diameter of the body of the power end rod.

8. A connection assembly, comprising:

the power end rod assembly of claim 1;

a piston rod assembly; and a link assembly that couples the power end rod assembly to the piston rod assembly.

9. The connection assembly of claim 8, wherein the link assembly comprises a hydraulic link assembly or a non-hydraulic, mechanical link assembly in contact with the wear plate when coupled to the power end rod assembly.

10. The connection assembly of claim 8, wherein the link assembly comprises an outer housing that is in contact with the wear plate at one end and in contact with the piston rod at an opposite end.

11. The connection assembly of claim 8, wherein the link assembly is coupled to the power end rod assembly by a releasable pin connection at one end and coupled to the piston rod assembly by another releasable pin connection at an opposite end.

12. A reciprocating pump, comprising:

a power end;

a fluid end; and the connection assembly of claim 8, wherein the power end rod assembly is coupled to the power end, wherein the piston rod assembly is coupled to the fluid end, and wherein the power end moves the connection assembly relative to the fluid end to draw fluid into the fluid end and then pressurize and pump the fluid out of the fluid end.

* * * * *